US009502840B2

(12) United States Patent
Kao et al.

(10) Patent No.: US 9,502,840 B2
(45) Date of Patent: Nov. 22, 2016

(54) ELECTRICAL RECEPTACLE CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Mao-Sheng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/971,562

(22) Filed: Dec. 16, 2015

(65) Prior Publication Data

US 2016/0181744 A1 Jun. 23, 2016

(30) Foreign Application Priority Data

Dec. 19, 2014 (TW) ..... 103144670 A

(51) Int. Cl.
*H01R 24/60* (2011.01)
*H01R 13/6581* (2011.01)

(52) U.S. Cl.
CPC ..... *H01R 24/60* (2013.01); *H01R 13/6581* (2013.01)

(58) Field of Classification Search
USPC ..... 439/676, 660, 701, 626, 350, 606
See application file for complete search history.

(56) References Cited

U.S. PATENT DOCUMENTS 6,902,407 B2 * 6/2005 Ito ..... G06K 7/0047 439/60
7,758,379 B2 * 7/2010 Chen ..... H01R 13/6485 439/607.11
7,997,937 B2 * 8/2011 Kondo ..... H01R 24/62 439/607.4
8,202,123 B1 * 6/2012 Lin ..... H01R 13/516 439/607.35
8,672,691 B2 * 3/2014 Kondo ..... H01R 13/6471 439/108
8,801,463 B2 * 8/2014 Tan ..... H01R 13/5202 439/607.04
8,845,363 B2 * 9/2014 Ardisana, II ..... B29C 45/14065 439/606

(Continued)

*Primary Examiner* — Alexander Gilman
(74) *Attorney, Agent, or Firm* — Muncy, Geissler, Olds & Lowe, P.C.

(57) ABSTRACT

An electrical receptacle connector includes an insulated housing, upper-row receptacle terminals, and lower-row receptacle terminals. The insulated housing includes a base portion and a tongue portion extended from one side of the base portion. The tongue portion has an upper surface, a lower surface, and a front lateral surface. The lower-row receptacle terminals correspond to the upper-row receptacle terminals and include signal terminals which include high speed transmitting terminals. Each of the high speed transmitting terminals includes a bending portion, an extension portion, and a cutout portion. The bending portion is extended upward from the front end of the flat contact portion and inserted into the tongue portion, the extension portion is extended forward from the top of the bending portion toward the front lateral surface, and the cutout portion is defined at the extension portion and near to the bending portion.

10 Claims, 11 Drawing Sheets

(56) References Cited

U.S. PATENT DOCUMENTS

| | | | | |
|---|---|---|---|---|
| 8,851,927 | B2 * | 10/2014 | Hsu | H01R 12/724 439/607.11 |
| 9,093,797 | B2 * | 7/2015 | Zhao | H01R 12/707 |
| 9,209,573 | B1 * | 12/2015 | Chen | H01R 13/6581 |
| 9,263,836 | B2 * | 2/2016 | Zhao | H01R 13/6594 |
| 9,281,626 | B2 * | 3/2016 | Lin | H01R 13/6581 |
| 9,293,869 | B2 * | 3/2016 | Ning | H01R 13/6594 |
| 9,312,641 | B2 * | 4/2016 | Wang | H01R 13/6585 |
| 9,318,856 | B2 * | 4/2016 | MacDougall | H01R 13/6581 |
| 9,337,588 | B2 * | 5/2016 | Chang | H01R 13/6594 |
| 9,362,680 | B2 * | 6/2016 | Kao | H01R 13/6583 |
| 2010/0136848 | A1 * | 6/2010 | Lin | H01R 12/724 439/701 |
| 2013/0288537 | A1 * | 10/2013 | Simmel | H01R 13/6583 439/660 |
| 2014/0248785 | A1 * | 9/2014 | Little | H01R 13/6585 439/95 |
| 2014/0273653 | A1 * | 9/2014 | Little | H01R 13/641 439/660 |
| 2015/0056839 | A1 * | 2/2015 | Zhang | H01R 12/724 439/350 |
| 2015/0072546 | A1 * | 3/2015 | Li | H01R 13/6585 439/96 |
| 2015/0111433 | A1 * | 4/2015 | Hou | H01R 12/707 439/626 |
| 2015/0263458 | A1 * | 9/2015 | Guo | H01R 12/724 439/607.4 |
| 2015/0270646 | A1 * | 9/2015 | Kao | H01R 13/6581 439/76.1 |
| 2015/0303623 | A1 * | 10/2015 | Kao | H01R 13/6583 439/607.04 |
| 2016/0013595 | A1 * | 1/2016 | Kao | H01R 13/6591 439/607.55 |

* cited by examiner

100

100

| | | | | | | | | | | | | |
|---|---|---|---|---|---|---|---|---|---|---|---|---|
| GND | TX1+ | TX1− | VBUS | CC1 | D+ | D− | RFU | VBUS | RX2− | RX2+ | GND | 31 |
| GND | RX1+ | RX1− | VBUS | RFU | D− | D+ | CC2 | VBUS | TX2− | TX2+ | GND | 41 |

Fig. 4B

ELECTRICAL RECEPTACLE CONNECTOR

CROSS-REFERENCES TO RELATED APPLICATIONS

This non-provisional application claims priority under 35 U.S.C. §119(a) on Patent Application No. 103144670 filed in Taiwan, R.O.C. on Dec. 19, 2014, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, micro USB interconnects are developed which include advantageous like small occupation volume and ease of portability. Therefore, the micro USB interconnects are widely adopted to smart mobile devices, digital cameras, or other portable electronic devices to mate with connecting cables for data transmission or power supply.

A conventional electrical receptacle connector having USB Type-C connection interface includes an insulated housing, a plurality of upper-row receptacle terminals, and a plurality of lower-row receptacle terminals. The insulated housing includes a base portion and a tongue portion extended from one side of the base portion. Each of the upper-row receptacle terminals is held in the base portion and the tongue portion, and the front portion of each of the upper-row receptacle terminals disposed is at an upper surface of the tongue portion. Each of the lower-row receptacle terminals is formed at the base portion and the tongue portion, and the front portion of each of the lower-row receptacle terminals is disposed at a lower surface of the tongue portion. Initially, the lower-row receptacle terminals are formed integrally to be a material band. During the manufacturing of the semi-product of the conventional electrical receptacle connector, insert-molding techniques are applied, such that the lower-row receptacle terminals and the insulated housing are formed integrally in the machining mold. Then, the material band is bent and removed. Therefore, the lower-row receptacle terminals are left at the insulated housing, and the semi-product of the conventional electrical receptacle connector can be made.

However, the front portion of each of the lower-row receptacle terminals of the conventional electrical receptacle connector is formed as a continuous bending structure. In other words, the continuous bending structure is a zigzag structure extended upward and forward to the material band. Due to the continuous bending structures (e.g., Z profile), the lower-row receptacle terminals are firmly formed in the tongue portion.

Due to the continuous bending structure of the high speed signal transmitting terminal of the lower-row receptacle terminal, a distance between the high speed signal transmitting terminal of the lower-row receptacle terminal and the corresponding high speed signal transmitting terminal of the upper-row receptacle terminal is so small, that capacitance effects and noise interferences are prone to be occurred during the transmission of high speed signals.

SUMMARY OF THE INVENTION

Therefore, how to improve the aforementioned issues are continuously researched by related personnel.

In view of this, the instant disclosure provides an electrical receptacle connector to improve the capacitance effects and the noise interferences induced by improper distance configuration between the upper-row receptacle terminals and the lower-row receptacle terminals during signal transmission.

An embodiment of the instant disclosure provides an electrical receptacle connector comprising a metallic shell, an insulated housing, a plurality of upper-row receptacle terminals, and a plurality of lower-row receptacle terminals. The metallic shell defines a receiving cavity therein. The insulated housing is received in the receiving cavity and comprises a base portion and a tongue portion extended from one side of the base portion. The tongue portion has an upper surface, a lower surface, and a front lateral surface, and the upper surface is opposite to the lower surface. The upper-row receptacle terminals comprise a plurality of signal terminals, at least one power terminal, and at least one ground terminal. Each of the upper-row receptacle terminals is held in the base portion and disposed at the upper surface. The lower-row receptacle terminals comprise a plurality of signal terminals, at least one power terminal, and at least one ground terminal. Each of the lower-row receptacle terminals is held in the base portion and disposed at the lower surface. Each of the lower-row receptacle terminals comprises a flat contact portion and a body portion. For each of the lower-row receptacle terminals, the body portion is held in the base portion, and the flat contact portion is extended from one end of the body portion and disposed at the lower surface. The signal terminals of the lower-row receptacle terminals comprise a plurality of high speed transmitting terminals. Each of the high speed transmitting terminals comprises a bending portion, an extension portion, and a cutout portion. For each of the high speed transmitting terminals, the bending portion is extended upward from the front end of the flat contact portion and inserted into the tongue portion, the extension portion is extended forward from the top of the bending portion toward the front lateral surface, and the cutout portion is defined at the extension portion and near to the bending portion. A first distance defined between the flat contact portion of each of the high speed transmitting terminals of the lower-row receptacle terminals and the corresponding upper-row receptacle terminal is greater than a second distance defined between the top of the bending portion of each of the high speed transmitting terminals of the lower-row receptacle terminals and the corresponding upper-row receptacle terminal.

Accordingly, for each of the high speed transmitting terminals of the lower-row receptacle terminals, electricity is no longer conducted over the whole terminal because of the cutout portion formed by removing the removing parts from the high speed transmitting terminal. As a result, without altering the manufacturing process for assembling the lower-row receptacle terminals with the insulated housing, the capacitance effects and noise interferences induced from extra conductor can be improved, and the high frequency performance can be improved, too. Besides, the position of the bending portion is closed to the signal terminal of the corresponding upper-row receptacle terminal. Therefore, for the electrical receptacle connector, the impedance can be reduced and the high frequency performance can be improved.

Furthermore, pin-assignments of the upper-row receptacle terminals and the lower-row receptacle terminals are 180 degree symmetrical, dual or double orientation design which enable an electrical plug connector to be inserted into the electrical receptacle connector in either of two intuitive orientations, i.e., in either upside-up or upside-down directions. In other words, the pin-assignments of the upper-row receptacle terminals and the lower-row receptacle terminals have 180 degree symmetrical, dual or double orientation design with respect to a central point of the receptacle cavity as the symmetrical center. Consequently, an electrical plug connector is inserted into the electrical receptacle connector with a first orientation where the upper surface of the tongue portion is facing up, for transmitting first signals. Conversely, the electrical plug connector is inserted into the electrical receptacle connector with a second orientation where the upper surface of the tongue portion is facing down, for transmitting second signals. Furthermore, the specification for transmitting the first signals is conformed to the specification for transmitting the second signals.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 4B is a schematic configuration diagram of receptacle terminals of the electrical receptacle connector shown in FIG. 4A;

DETAILED DESCRIPTION

Figure 1:
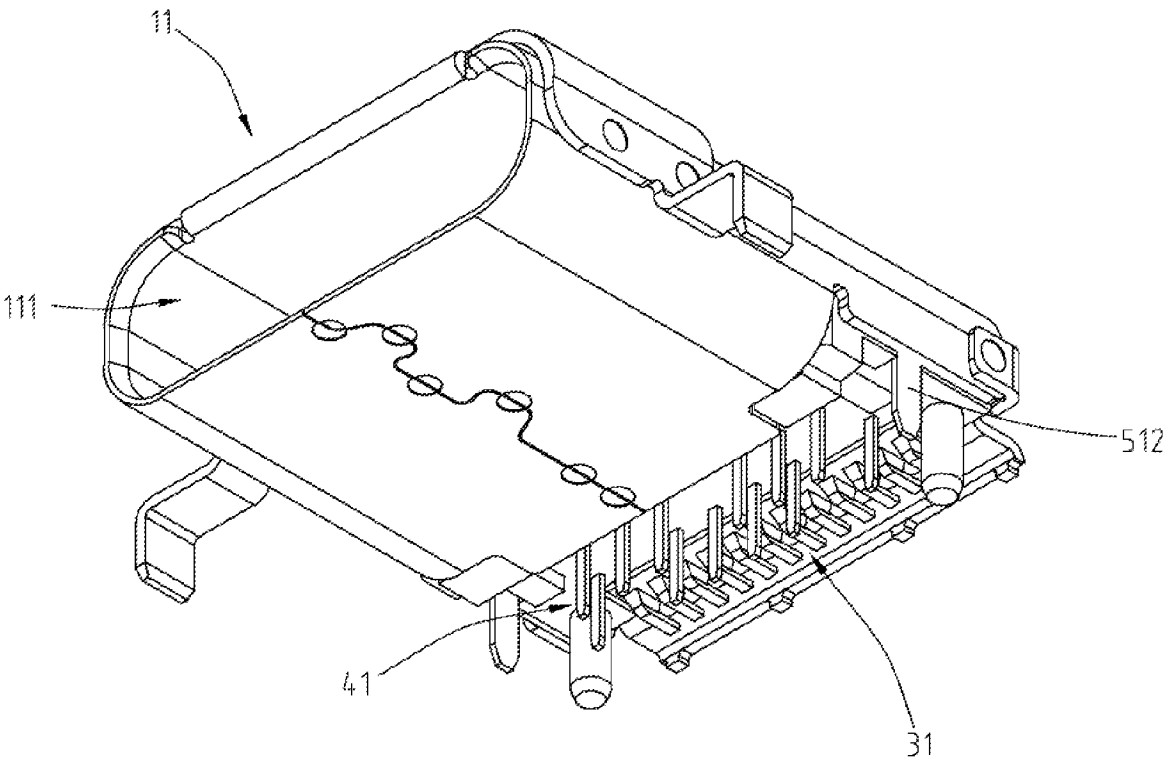
FIG. 1 is a perspective view of an electrical receptacle connector according to the instant disclosure.
Figure 2:
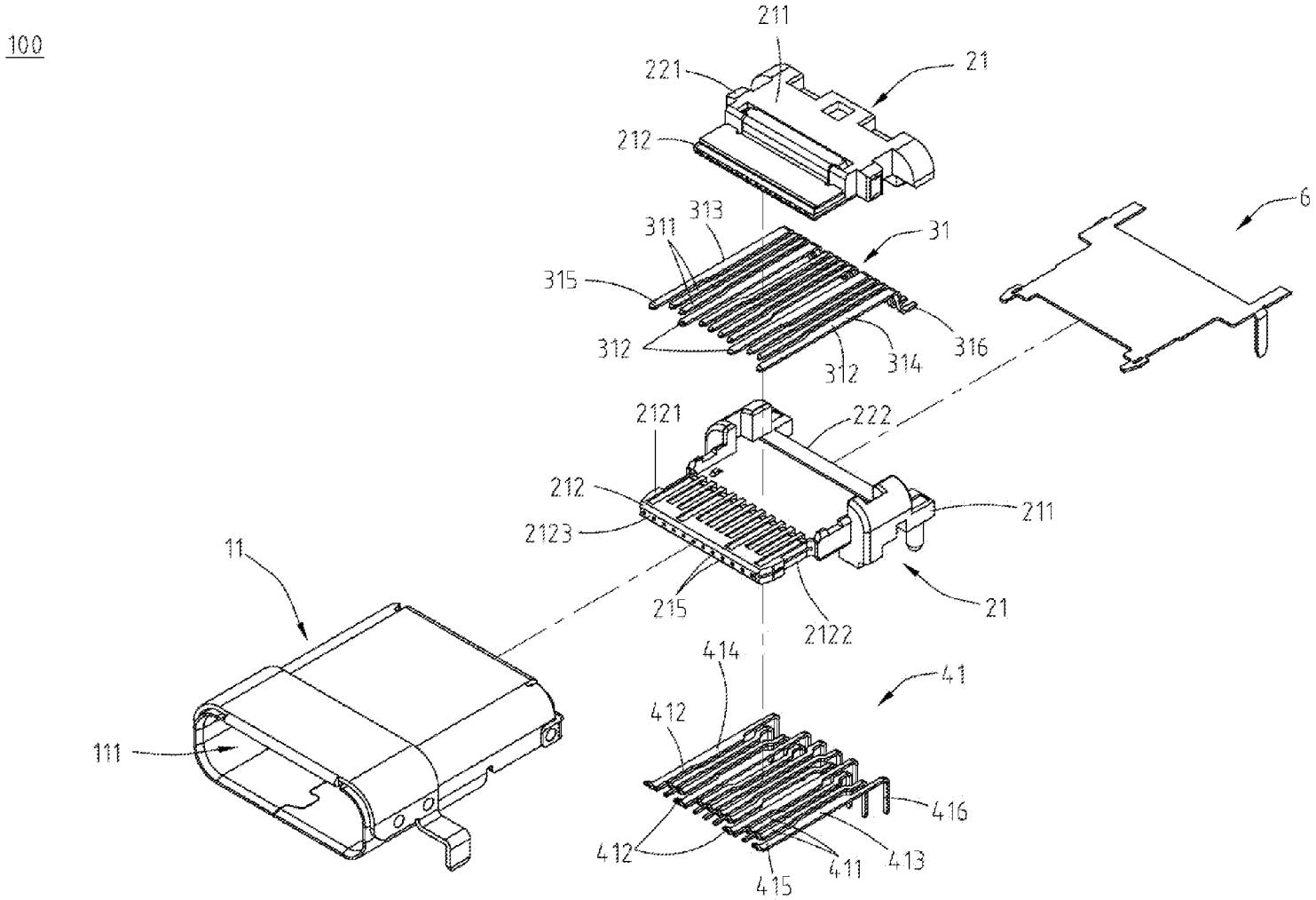
FIG. 2 is an exploded view of the electrical receptacle connector according to the instant disclosure.
Figure 3:
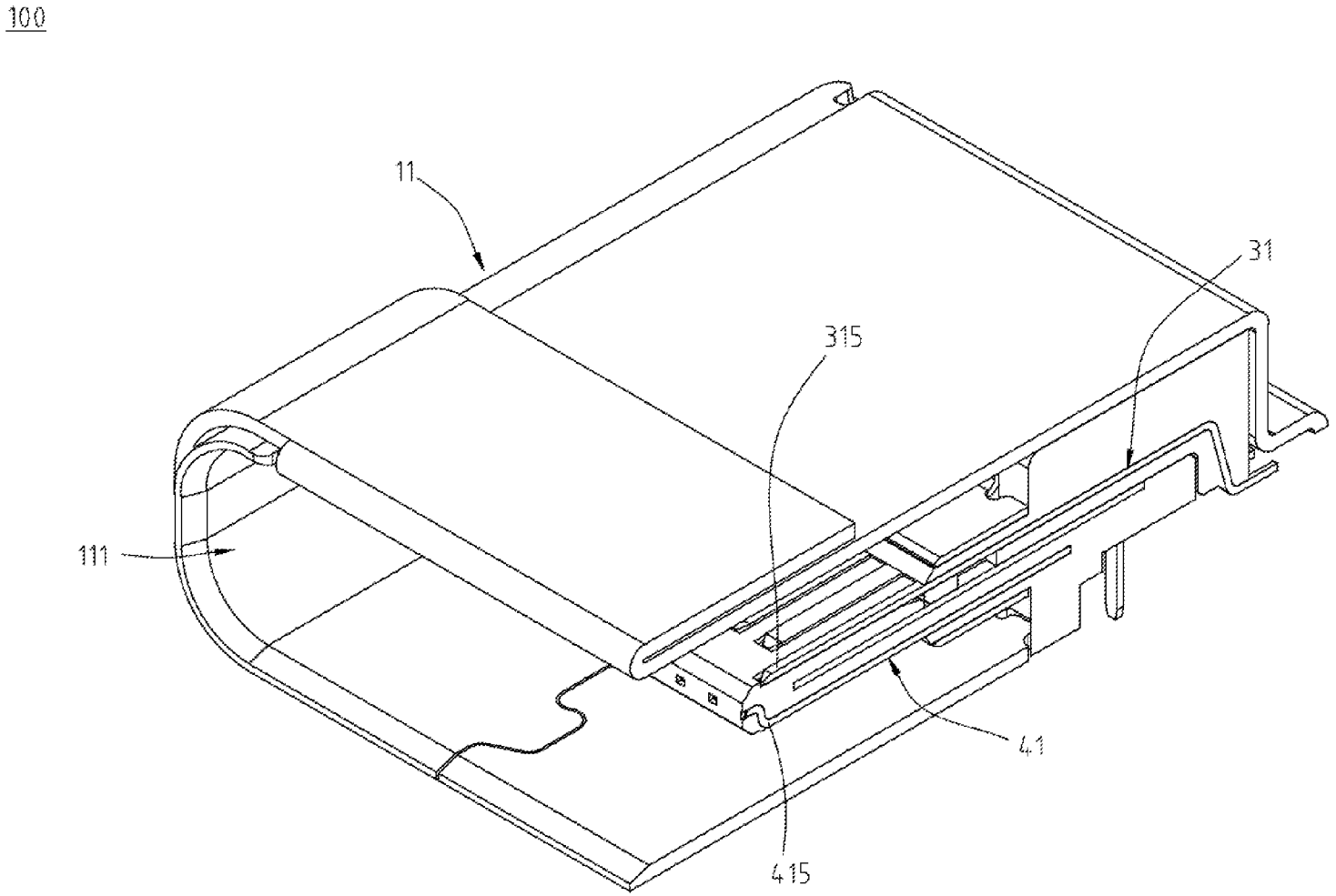
FIG. 3 is a cross-sectional view of the electrical receptacle connector according to the instant disclosure, along a direction from the front to the rear of the electrical receptacle connector.

Please refer to FIG. 1 to FIG. 3, illustrating an exemplary embodiment of an electrical receptacle connector 100 according to the instant disclosure. FIG. 1 is a perspective view, FIG. 2 is an exploded view, and FIG. 3 is a cross-sectional view, of the electrical receptacle connector 100. The electrical receptacle connector 100 described herein is an electrical connector having USB Type-C connecting interfaces. In this embodiment, the electrical receptacle connector 100 comprises a metallic shell 11, an insulated housing 21, a plurality of upper-row receptacle terminals 31, and a plurality of lower-row receptacle terminals 41. In addition, the electrical receptacle connector 100 further comprises a grounding sheet 6 disposed in the insulated housing 21 and located between the upper-row receptacle terminals 31 and the lower-row receptacle terminals 41.

Please refer to FIG. 2 and FIG. 3. The metallic shell 11 is a hollowed shell and defines a receiving cavity 111 therein. In this embodiment, the metallic shell 11 may be formed by bending a unitary member. The metallic shell 11 defines an insertion opening therein. The insertion opening may be, but not limited to, oblong shaped or rectangular shaped. The insertion opening communicates with the receiving cavity 111. Therefore, an electrical plug connector may be inserted into the insertion opening of the electrical receptacle connector 100.

Specifically, FIG. 2 is an exploded view showing a first body 221 and a second body 222 of the electrical receptacle connector 100, and FIG. 3 is a cross-sectional view showing the first body 221 and the second body 222 are assembled with each other and received in the metallic shell 11. Please refer to FIG. 2 and FIG. 3. The insulated housing 21 is received in the receiving cavity 111. That is, the metallic shell 11 surrounds four sides of the insulated housing 21. The insulated housing 21 comprises a base portion 211 and a tongue portion 212 extended from one side of the base portion 211. Here, a first body 221 and a second body 222 are combined with each other to form the insulated housing 21. That is, the assembly of the first body 221 and the second body 222 forms the base portion 211 and the tongue portion 212. In addition, the first body 221 is formed as parts of the tongue portion 212 and the upper part of the base portion 211, and the second body 222 is formed as the rest part of the tongue portion 212 and the lower part of the base portion 211, but embodiments are not limited thereto. In some embodiments, the base portion 211 and the tongue portion 212 are formed integrally as a whole by injection molding techniques. Additionally, the tongue portion 212 has an upper surface 2121, a lower surface 2122, and a front lateral surface 2123.

Please refer to FIG. 2, FIG. 3, FIG. 4A, and FIG. 4B. The upper-row receptacle terminals 31 are held in the base portion 211 and the tongue portion 212. Here, the first body 221 and the upper-row receptacle terminals 31 are formed integrally as a whole by insert-molding techniques. Each of the upper-row receptacle terminals 31 comprises a flat contact portion 315, a body portion 314, and a tail portion 316. For each of the upper-row receptacle terminals 31, the body portion 314 is held in the base portion 211 and the tongue portion 212, the flat contact portion 315 is extended from one of two ends of the body portion 314 and disposed at the upper surface 2121, and the tail portion 316 is extended from the other end of the body portion 314 and protruded from the base portion 211. The upper-row receptacle terminals 31 are disposed at the upper surface 2121 and transmit first signals (namely, USB 3.0 signals). The tail portions 316 are protruded from the bottom of the base portion 211 and bent horizontally to form flat legs, named SMT legs which can be soldered or mounted on the surface of a circuit board using surface mount technology.

Please refer to FIG. 2, FIG. 3, FIG. 4A, and FIG. 4B. The lower-row receptacle terminals 41 are held in the base portion 211 and the tongue portion 212. Here, the second body 222 and the lower-row receptacle terminals 41 are formed integrally as a whole by insert-molding techniques. A plurality of terminal slots is defined on the front portion of the second body 222. Each of the terminal slots is provided for assembling the flat contact portion 315 of the corresponding upper-row receptacle terminal 31. The lower-row receptacle terminals 41 are below the upper-row receptacle terminals 31 and define an interval between the upper-row receptacle terminals 31. Each of the lower-row receptacle terminals 41 comprises a flat contact portion 415, a body portion 414, and a tail portion 416. For each of the lower-row receptacle terminals 41, the body portion 414 is held in the base portion 211 and the tongue portion 212, the flat contact portion 415 is extended from one of two ends of the body portion 414 and disposed at the lower surface 2122, and the tail portion 416 is extended from the other end of the body portion 414 and protruded from the base portion 211. The lower-row receptacle terminals 41 are disposed at the lower surface 2122 and transmit second signals (namely, USB 3.0 signals). The tail portions 416 are protruded from the bottom of the base portion 211 and bent downward vertically to form vertical legs, named through-hole legs which can be soldered on the surface of a circuit board by through hole technology. In this embodiment, the tail portions 316 and the tail portions 416 are protruded from the base portion 211 and arranged separately. The terminal configuration may be, but not limited to, grouped into three rows.

Figure 4A:
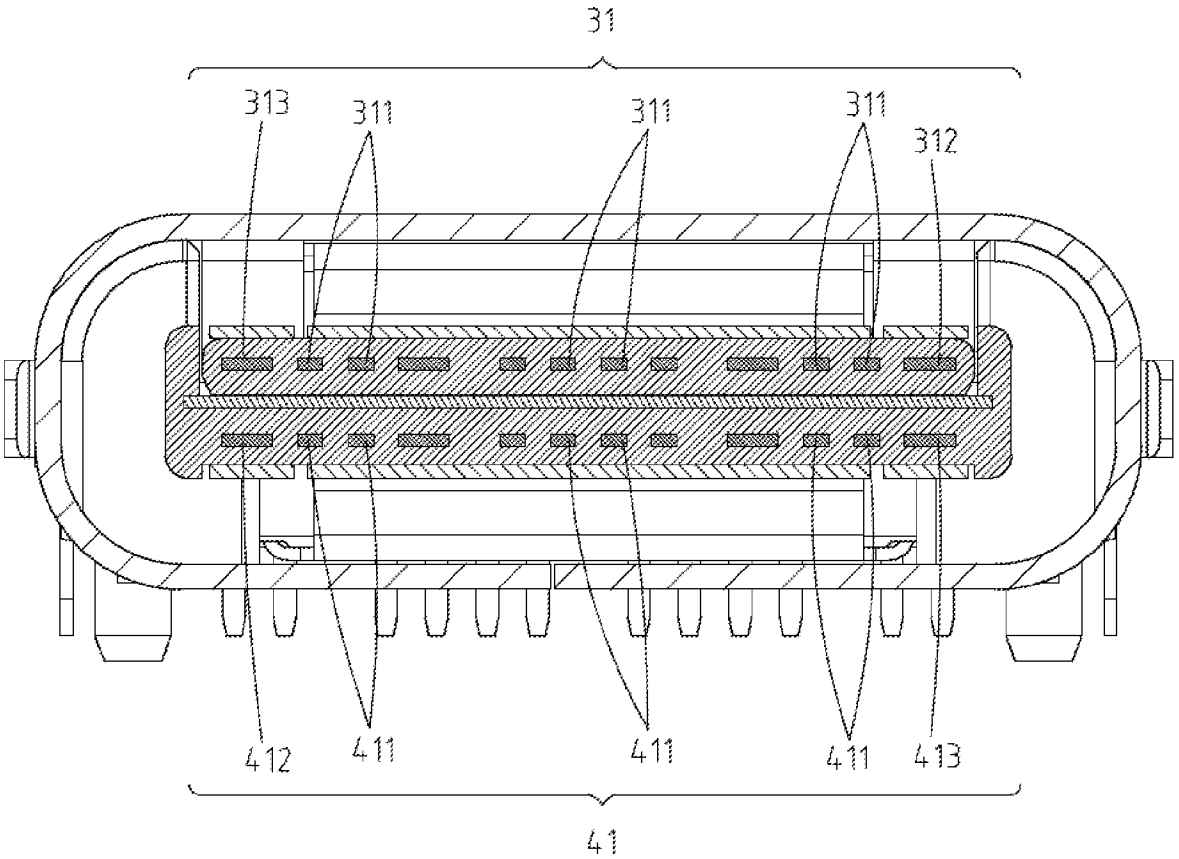
FIG. 4A is a front sectional view of the electrical receptacle connector according to the instant disclosure.
Figure 5:
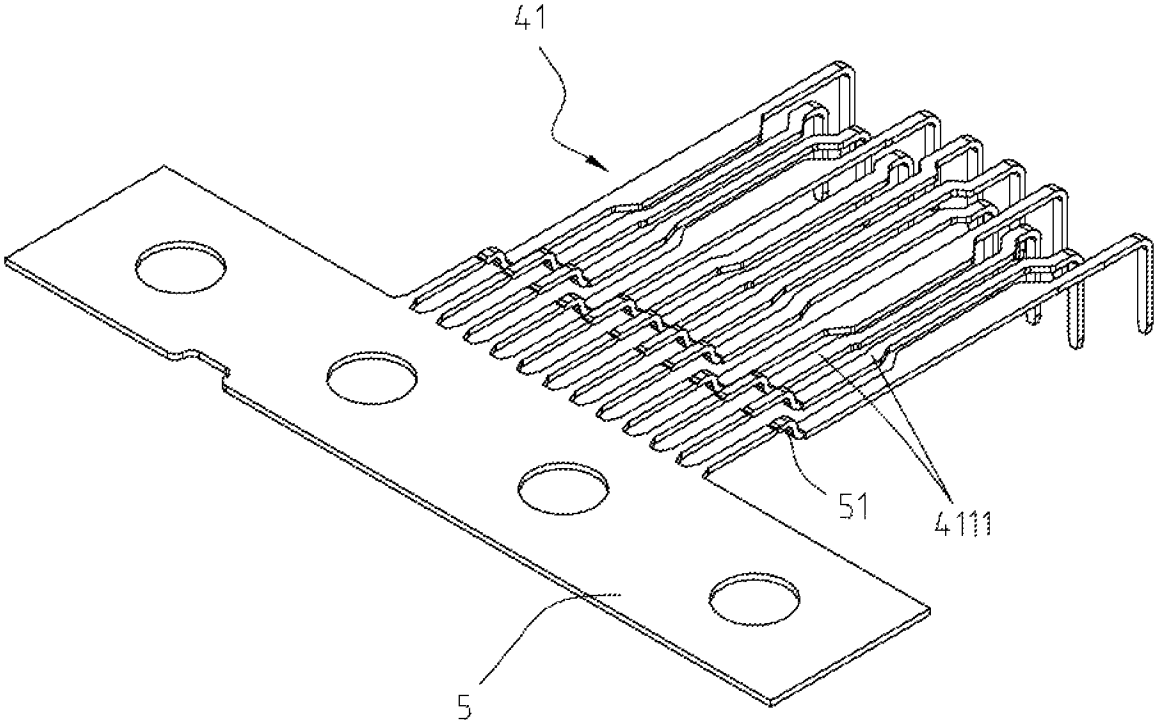
FIG. 5 is a perspective view showing an assembly of lower-row receptacle terminals and a material band.

Please refer to FIG. 4A and FIG. 4B. In this embodiment, the upper-row receptacle terminals 31 comprise a plurality of signal terminals 311, at least one power terminal 312, and at least one ground terminal 313. Referring to FIG. 1C, the upper-row receptacle terminals 31 comprise, from left to right, a ground terminal 313 (Gnd), a first pair of differential signal terminals (TX1+−), a second pair of differential signal terminals (D+−), and a third pair of differential signal terminals (RX2+−) of the signal terminals 311, power terminals 312 (Power/VBUS) between the three pairs of differential signal terminals, a retain terminal (RFU), (the retain terminal and a configuration channel 1 (CC1) are respectively arranged between the power terminals 312 and the second pair of differential signal terminals of the signal terminals 311), and another ground terminal 313 (Gnd). However, the terminal configurations are not thus limited, and the example described here is only for illustrative purposes. In this embodiment, twelve upper-row receptacle terminals 31 are provided to meet the transmission of USB 3.0 signals, but embodiments are not limited thereto. In some embodiments, the far right ground terminal 313 (or the far left ground terminal 313) and the retain terminal are omitted. In addition, the far right ground terminal 313 may be replaced by a power terminal 312 and provided for power transmission.

Please refer to FIG. 4A and FIG. 4B. In this embodiment, the lower-row receptacle terminals 41 comprise a plurality of signal terminals 411, at least one power terminal 412, and at least one ground terminal 413. Referring to FIG. 1C, the lower-row receptacle terminals comprise, from right to left, a ground terminal 413 (Gnd), a first pair of differential signal terminals (TX2+−, i.e., high speed transmitting terminals 4111), a second pair of differential signal terminals (D+−), and a third pair of differential signal terminals (RX1+−, i.e., high speed transmitting terminals 4111) of the signal terminals 411, power terminals 412 (Power/VBUS) between the three pairs of differential signal terminals, a retain terminal (RFU), (the retain terminal and a configuration channel 2 (CC2) are respectively arranged between the power terminals 412 and the second pair of differential signal terminals of the signal terminals 411), and another ground terminal 413 (Gnd). However, the terminal configurations are not thus limited, and the example described here is only for illustrative purposes. In this embodiment, twelve lower-row receptacle terminals 41 are provided to meet the transmission of USB 3.0 signals, but embodiments are not limited thereto. In some embodiments, the far right ground terminal 413 (or the far left ground terminal 413) and the retain terminal are omitted. In addition, the far right ground terminal 413 may be replaced by a power terminal 412 and provided for power transmission.

In the previous embodiments, the upper-row receptacle terminals 31 and the lower-row receptacle terminals 41 meet the transmission of USB 3.0 signals, but embodiments are not limited thereto. In some embodiments, for the upper-row receptacle terminals 31 in accordance with the transmission of USB 2.0 signals, the first and third pairs of differential signal terminals are omitted, and the second pair of differential signal terminals and the power terminals 312 are retained for transmitting USB 2.0 signals. For the lower-row receptacle terminals 41 in accordance with the transmission of USB 2.0 signals, the first and third pairs of differential signal terminals are omitted, and the second pair of differential signal terminals and the power terminals 412 are retained for transmitting USB 2.0 signals.

Please refer to FIG. 4A and FIG. 4B. In this embodiment, the upper-row receptacle terminals 31 and the lower-row receptacle terminals 41 are respectively disposed at the upper surface 2121 and the lower surface 2122 of the tongue portion 212. In this embodiment, as shown in FIG. 4B, the terminal configuration of the upper-row receptacle terminals 31 corresponds to that of the lower-row receptacle terminals 41. In addition, the upper-row receptacle terminals 31 and the lower-row receptacle terminals 41 are point-symmetrical with a central point of the receiving cavity 111 as the symmetrical center. In other words, pin-assignments of the upper-row receptacle terminals 31 and the lower-row receptacle terminals 41 have 180 degree symmetrical design with respect to the central point of the receptacle cavity 111 as the symmetrical center. The dual or double orientation design enables an electrical plug connector to be inserted into the electrical receptacle connector 100 in either of two intuitive orientations, i.e., in either upside-up or upside-down directions. Here, point-symmetry means, after the upper-row receptacle terminals 31 (or the lower-row receptacle terminals 41) are rotated by 180 degrees with the symmetrical center as the rotating center, the upper-row receptacle terminals 31 and the lower-row receptacle terminals 41 are overlapped. That is, the rotated upper-row receptacle terminals 31 are arranged at the position of the original lower-row receptacle terminals 41, and the rotated lower-row receptacle terminals 41 are arranged at the position of the original upper-row receptacle terminals 31. In other words, the upper-row receptacle terminals 31 and the lower-row receptacle terminals 41 are arranged upside down, and the terminal configurations of the upper-row receptacle terminals 31 are left-right reversal with respect to the terminal configuration of the lower-row receptacle terminals 41. Accordingly, an electrical plug connector is inserted into the electrical receptacle connector 100 with a first orientation where the upper surface 2121 is facing upward, for transmitting first signals. Conversely, the electrical plug connector is inserted into the electrical receptacle connector 100 with a second orientation where the upper surface 2121 is facing downward, for transmitting second signals.

The specification for transmitting the first signals conforms to that for transmitting the second signals. Based on this, the inserting orientation of the electrical plug connector is not limited by the electrical receptacle connector 100, and the electrical plug connector can be mated with the electrical receptacle connector 100 in either two intuitive orientations.

Please refer to FIG. 2, FIG. 5, FIG. 6, and FIG. 7. Additionally, during forming the lower-row receptacle terminals 41 to the tongue portion 212, the tongue portion 212 defines a plurality of openings 215 due to the existence of the lower-row receptacle terminals 41. Particularly, the openings 215 are defined at the front lateral surface 2123 of the tongue portion 212, and extension portions 418 of the high speed transmitting terminals 4111 are received in the respective openings 215. Here, the front end of each of the extension portions 418 is extended toward the front lateral surface 2123 of the tongue portion 212. Alternatively, the front end of each of the extension portions 418 may be in the corresponding opening 215.

Figure 7:
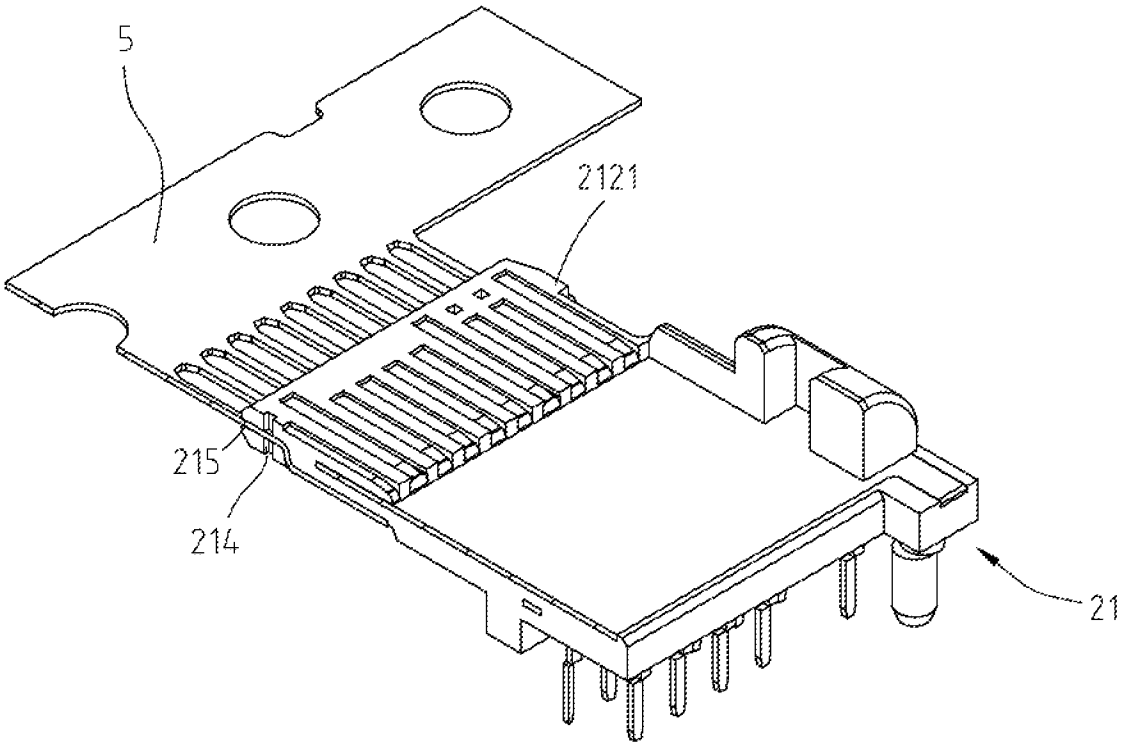
FIG. 7 is a cross-sectional view of an insulated housing of the electrical receptacle connector according to the instant disclosure, in which the insulated housing has cutout holes.
Figure 8:
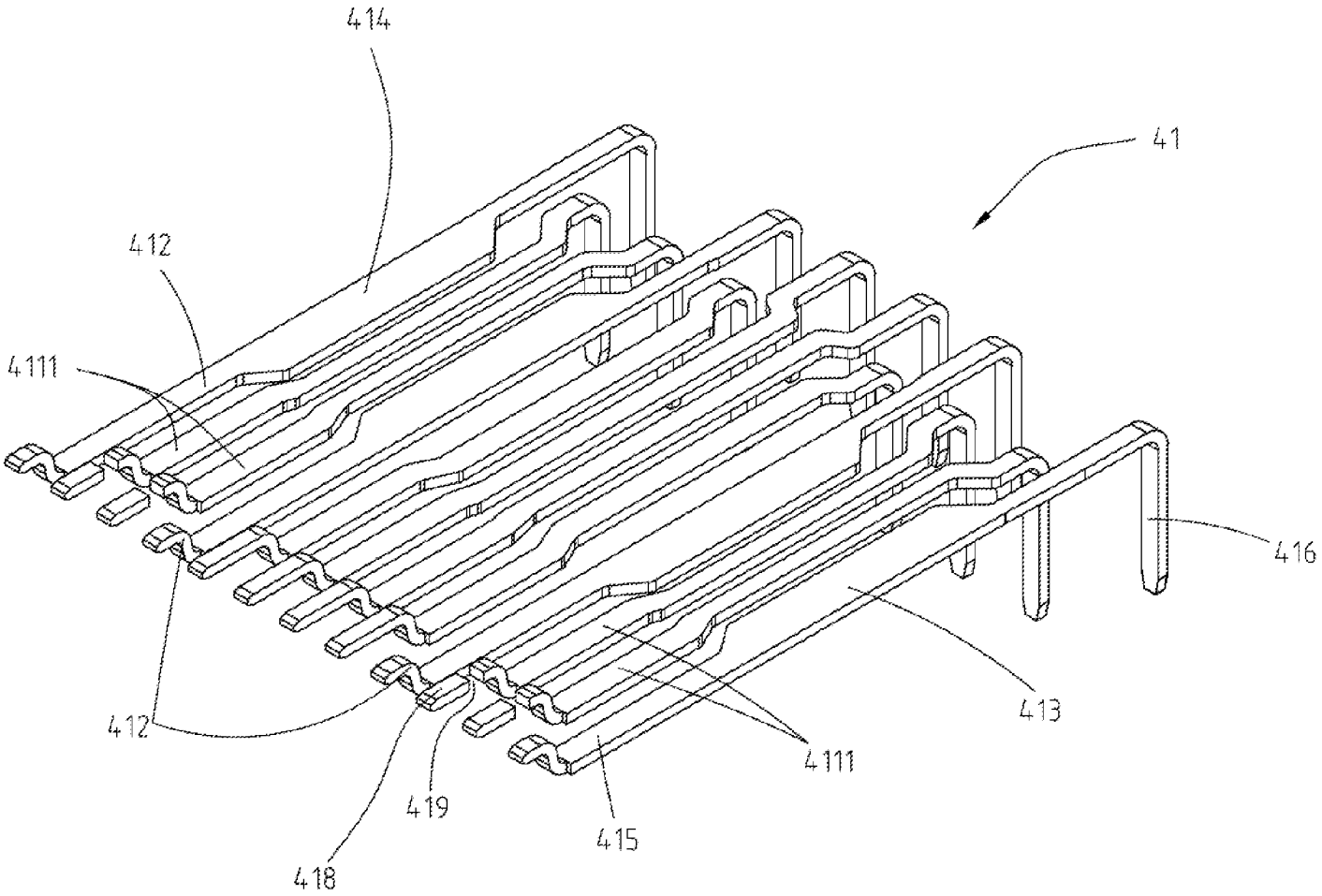
FIG. 8 is a perspective view of the lower-row receptacle terminals of the electrical receptacle connector according to the instant disclosure, in which parts of high speed transmitting terminals of the lower-row receptacle terminals are removed.
Figure 9:
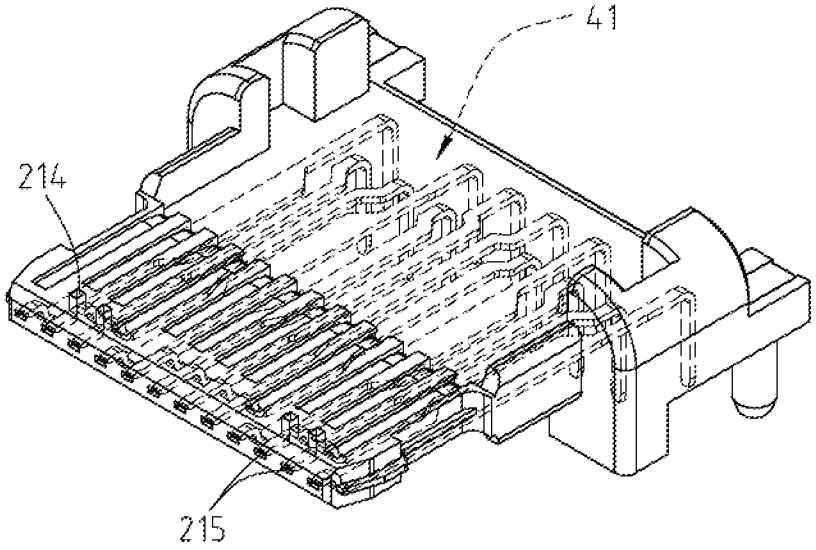
FIG. 9 is a perspective view of the insulated housing having the cutout holes of the electrical receptacle connector according to the instant disclosure.

Please refer to FIG. 2, FIG. 7, and FIG. 8. In this embodiment, the signal terminals 411 comprise a plurality of high speed transmitting terminals 4111 (i.e., the first pair of differential signal terminals and the third pair of differential signal terminals). Each of the high speed transmitting terminals 4111 comprises a bending portion 417, an extension portion 418, and a cutout portion 419. For each of the high speed transmitting terminals 4111, the bending portion 417 is extended upward from the front end of the flat contact portion 415 to be inserted into the tongue portion 212, the extension portion 418 is extended forward from the top of the bending portion 417 toward the front lateral surface 2123, and the cutout portion 419 is defined at the extension portion 418 and near to the bending portion 417. Moreover, the distance between the flat contact portion 415 of each of the high speed transmitting terminals 4111 and the front lateral surface 2123 is greater than the distance between the flat contact portion 415 of the power terminal 412 and the front lateral surface 2123. In other words, when an electrical plug connector is connected with the electrical receptacle connector 100, plug terminals of the electrical plug connector contact the power terminals 412 firstly and then contact the high speed transmitting terminals 4111.

Please refer to FIG. 2, FIG. 5, FIG. 6, and FIG. 7. The lower-row receptacle terminals 41 and a material band 5 are integrally formed as a whole. That is, the electrical receptacle connector 100 further comprises a material band 5 extended to each of the extension portions 418. The material band 5 comprises a plurality of breaking portions 51 received in the respective openings 215. Alternatively, the breaking portions 51 may be located at the front lateral surface 2123 of the tongue portion 212. After the lower-row receptacle terminals 41 are formed at the insulated housing 21, the material band 5 is bent, so that the material band 5 and the lower-row receptacle terminals 41 are broken at the breaking portions 51, enabling the material band 5 to be removed. Therefore, the lower-row receptacle terminals 41 can be fixedly positioned in the mold when the lower-row receptacle terminals 41 are to be formed at the insulated housing 21. That is, when the lower-row receptacle terminals 41 are to be formed at the insulated housing 21, the lower-row receptacle terminals 41 are supported steadily by the material band 5 and formed at the insulated housing 21. For each of the high speed transmitting terminals 4111, the bending portion 417 is bent upward and inserted into the tongue portion 212, and the extension portion 418 at the top of the bending portion 417 is further extended toward the material band 5. Therefore, the flat contact portion 415 of each of the lower-row receptacle terminals 41 can be positioned at the lower surface 2122 of the tongue portion 212.

Figure 6:
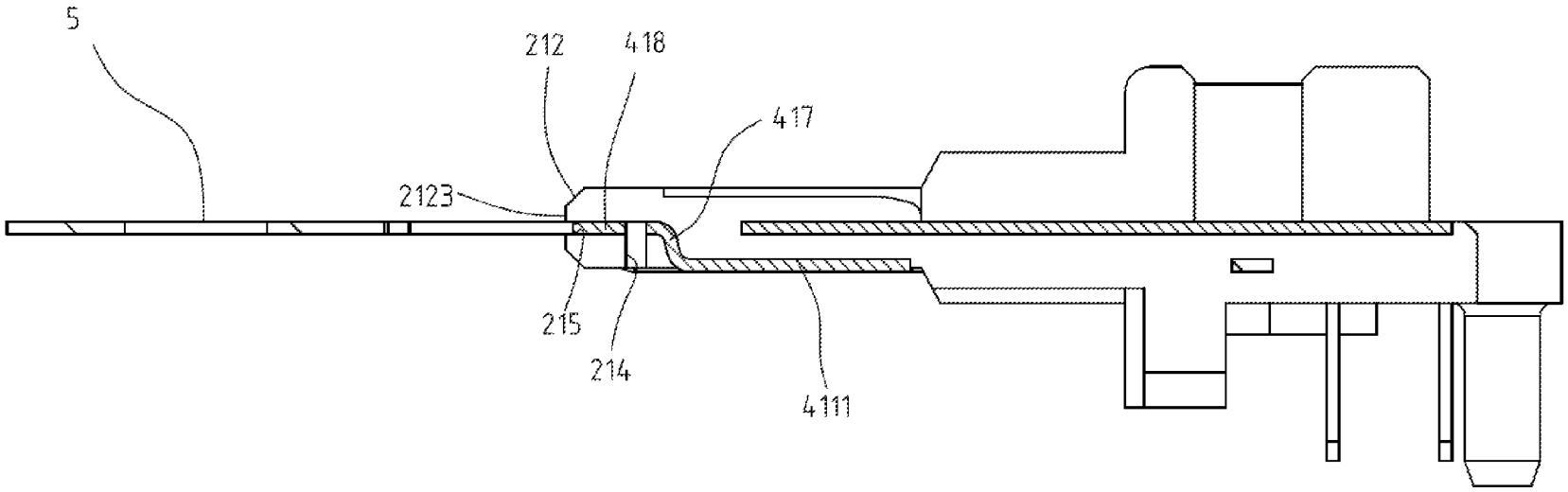
FIG. 6 is a sectional view showing the lower-row receptacle terminals of the electrical receptacle connector are linked to the material band.

Please refer to FIG. 2, FIG. 6, FIG. 9, and FIG. 10. In this embodiment, the tongue portion 212 defines a plurality of cutout holes 214 each extended from the upper surface 2121 or the lower surface 2122 to the corresponding extension portion 418. As shown in FIG. 6, each of the cutout holes 214 is extended from the lower surface 2122 toward the corresponding extension portion 418, but embodiments are not limited thereto. Alternatively, each of the cutout holes 214 is extended from the upper surface 2121 toward the lower surface 2122 and defined through the tongue portion 21. The cutout portions 419 are material-removed sections. Namely, for each of the high speed transmitting terminals 4111, the cutout portion 419 is the void between the rest part of the extension portion 418 and the bending portion 417 (i.e., parts of the extension portion 418 is removed (hereinafter, called removing parts) and the void is formed as the cutout portion 419). The formation of the cutout portion 419 is accomplished by inserting a machining fixture into the cutout hole 214 to cut off parts of the extension portion 418. Therefore, the cutout portion 419 is defined between the rest part of the extension portion 418 and the bending portion 417.

Figure 10:
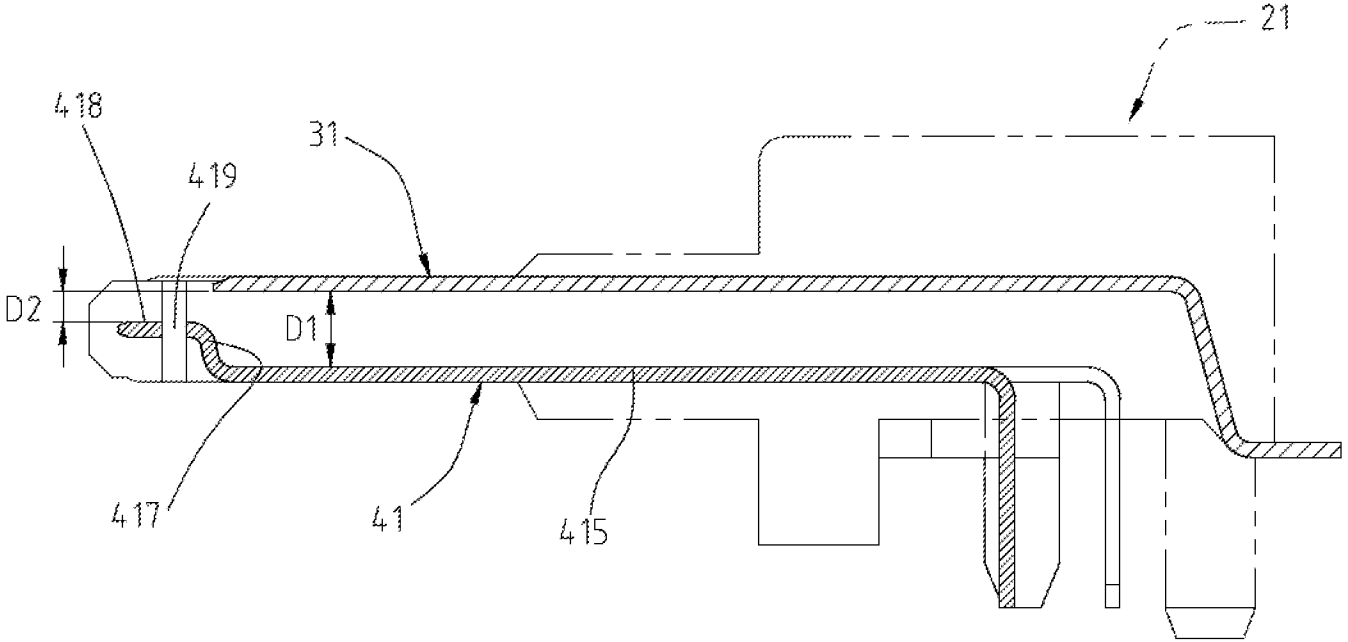
FIG. 10 is a lateral view of the insulated housing having the cutout holes of the electrical receptacle connector according to the instant disclosure.

Please refer to FIG. 2 and FIG. 10. In addition, a first distance D1 between the flat contact portion 415 of each of the high speed transmitting terminals 4111 and the corresponding upper-row receptacle terminal 31 is greater than a second distance D2 between the top of the bending portion 417 of each of the high speed transmitting terminals 4111 and the corresponding upper-row receptacle terminal 31. In other words, for each of the high speed transmitting terminals 4111, the flat contact portion 415 is disposed at the lower surface 2122, and the top of the bending portion 417 is received in the tongue portion 212. Besides, the position of the bending portion 417 is closed to the signal terminal 311 of the corresponding upper-row receptacle terminal 31. Therefore, for the electrical receptacle connector 100, the impedance can be reduced and the high frequency performance can be improved. For each of the high speed transmitting terminals 4111, electricity is no longer conducted over the whole terminal because of the cutout portion 419 formed by removing the removing parts from the high speed transmitting terminal 4111. As a result, without altering the manufacturing process for assembling the lower-row receptacle terminals 41 with the insulated housing 21, the capacitance effects and noise interferences induced from extra conductor can be improved, and the high frequency performance can be improved, too.

According to the instant disclosure, for each of the high speed transmitting terminals, electricity is no longer conducted over the whole terminal because of the cutout portion formed by removing the removing parts from the high speed transmitting terminal. As a result, without altering the manufacturing process for assembling the lower-row receptacle terminals with the insulated housing, the capacitance effects and noise interferences induced from extra conductor can be improved, and the high frequency performance can be improved, too. Besides, the position of the bending portion is closed to the signal terminal of the corresponding upper-row receptacle terminal. Therefore, for the electrical receptacle connector, the impedance can be reduced and the high frequency performance can be improved.

Furthermore, pin-assignments of the upper-row receptacle terminals and the lower-row receptacle terminals are 180 degree symmetrical, dual or double orientation design which enable an electrical plug connector to be inserted into the electrical receptacle connector in either of two intuitive orientations, i.e., in either upside-up or upside-down directions. In other words, the pin-assignments of the upper-row receptacle terminals and the lower-row receptacle terminals have 180 degree symmetrical, dual or double orientation design with respect to a central point of the receptacle cavity as the symmetrical center. Consequently, an electrical plug connector is inserted into the electrical receptacle connector with a first orientation where the upper surface of the tongue portion is facing up, for transmitting first signals. Conversely, the electrical plug connector is inserted into the electrical receptacle connector with a second orientation where the upper surface of the tongue portion is facing down, for transmitting second signals. Furthermore, the specification for transmitting the first signals is conformed to the specification for transmitting the second signals.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell, defining a receiving cavity therein;

an insulated housing received in the receiving cavity, wherein the insulated housing comprises a base portion and a tongue portion extended from one side of the base portion, wherein the tongue portion has an upper surface, a lower surface, and a front lateral surface, the upper surface is opposite to the lower surface;

a plurality of upper-row receptacle terminals comprising a plurality of signal terminals, at least one power terminal, and at least one ground terminal, wherein each of the upper-row receptacle terminals is held in the base portion and disposed at the upper surface; and a plurality of lower-row receptacle terminals comprising a plurality of signal terminals, at least one power terminal, and at least one ground terminal, wherein each of the lower-row receptacle terminals is held in the base portion and disposed at the lower surface, wherein each of the lower-row receptacle terminals comprises a flat contact portion and a body portion, each of the body portions is held in the base portion, each of the flat contact portions is extended from one of two ends of the body portion and is disposed at the lower surface, wherein the signal terminals comprise a plurality of high speed transmitting terminals, each of the high speed transmitting terminals comprises a bending portion, an extension portion, and a cutout portion, wherein the bending portion is extended upward from the front end of the flat contact portion and inserted into the tongue portion, wherein the extension portion is extended forward from the top of the bending portion toward the front lateral surface, wherein the cutout portion is defined at the extension portion and near to the bending portion, and wherein a first distance defined between the flat contact portion of each of the high speed transmitting terminals of the lower-row receptacle terminals and the corresponding upper-row receptacle terminal is greater than a second distance defined between the top of the bending portion of each of the high speed transmitting terminals of the lower-row receptacle terminals and the corresponding upper-row receptacle terminal.

2. The electrical receptacle connector according to claim 1, wherein the tongue portion defines a plurality of cutout holes each extended from the upper surface or the lower surface to the corresponding extension portion.

3. The electrical receptacle connector according to claim 1, wherein the tongue portion defines a plurality of openings, each of the openings is formed at the front lateral surface, the extension portions are received in the openings, respectively.

4. The electrical receptacle connector according to claim 3, further comprising a material band extended to each of the extension portion, the material band comprises a plurality of breaking portions received in the openings, respectively.

5. The electrical receptacle connector according to claim 1, wherein the distance between the flat contact portion of each of the high speed transmitting terminals of the lower-row receptacle terminals and the front lateral surface is greater than the distance between the flat contact portion of the power terminal of the lower-row receptacle terminals and the front lateral surface.

6. The electrical receptacle connector according to claim 1, wherein each of the upper-row receptacle terminals comprises a flat contact portion, a body portion, and a soldering portion, the body portion is held in the base portion, the flat contact portion is extended from one of two ends of the body portion and disposed at the upper surface, and the soldering portion is extended from the other end of the body portion and protruded from the base portion.

7. The electrical receptacle connector according to claim 1, wherein each of the lower-row receptacle terminals comprises a soldering portion extended from the other end of the body portion and protruded from the base portion.

8. The electrical receptacle connector according to claim 1, further comprising a grounding sheet, the grounding sheet is disposed at the insulated housing and is located between the upper-row receptacle terminals and the lower-row receptacle terminals.

9. The electrical receptacle connector according to claim 1, wherein the upper-row receptacle terminals and the lower-row receptacle terminals have 180 degree symmetrical design with respect to a central point of the receptacle cavity as the symmetrical center.

10. The electrical receptacle connector according to claim 9, wherein the position of the upper-row receptacle terminals correspond to the position of the lower-row receptacle terminals.

* * * * *